US005310705A

United States Patent [19]

Mitlitsky et al.

[11] Patent Number: 5,310,705

[45] Date of Patent: May 10, 1994

[54] HIGH-FIELD MAGNETS USING HIGH-CRITICAL-TEMPERATURE SUPERCONDUCTING THIN FILMS

[75] Inventors: Fred Mitlitsky; Ronald W. Hoard, both of Livermore, Calif.

[73] Assignee: The United States of America as represented by the United States Department of Energy, Washington, D.C.

[21] Appl. No.: 312

[22] Filed: Jan. 4, 1993

[51] Int. Cl.[5] ..... H01B 12/00; H01F 7/22; H01F 10/08

[52] U.S. Cl. ..... 505/211; 335/216; 505/705; 505/879; 505/880; 505/213; 336/DIG. 1

[58] Field of Search ..... 335/216; 336/DIG. 1; 365/161; 505/701, 705, 706, 833

[56] References Cited

U.S. PATENT DOCUMENTS

| | | | |
|---|---|---|---|
| 3,281,737 | 9/1963 | Swartz | 335/216 |
| 3,281,738 | 10/1966 | Hanak | 335/216 |
| 4,942,142 | 7/1990 | Itozaki et al. | 505/1 |
| 4,948,779 | 8/1990 | Keur et al. | 505/1 |
| 4,959,346 | 9/1990 | Mogro-Campero et al. | 505/1 |
| 4,959,348 | 9/1990 | Higashibata et al. | 505/1 |
| 4,962,086 | 10/1990 | Gallagher et al. | 505/1 |
| 4,965,247 | 10/1990 | Nishiguchi | 505/1 |
| 5,079,222 | 1/1992 | Yamazaki | 505/1 |
| 5,099,162 | 3/1992 | Sawada | 310/198 |
| 5,173,678 | 12/1992 | Bellows | 335/216 |

FOREIGN PATENT DOCUMENTS

| | | | |
|---|---|---|---|
| 0107004 | 5/1988 | Japan | 335/216 |
| 2203909 | 10/1988 | United Kingdom | 335/301 |

*Primary Examiner*—Leo P. Picard
*Assistant Examiner*—Stephen T. Ryan
*Attorney, Agent, or Firm*—Henry Sartorio; Roger S. Gaither; William R. Moser

[57] ABSTRACT

High-field magnets fabricated from high-critical-temperature superconducting ceramic (HTSC) thin films which can generate fields greater than 4 Tesla. The high-field magnets are made of stackable disk-shaped substrates coated with HTSC thin films, and involves maximizing the critical current density, superconducting film thickness, number of superconducting layers per substrate, substrate diameter, and number of substrates while minimizing substrate thickness. The HTSC thin films are deposited on one or both sides of the substrates in a spiral configuration with variable line widths to increase the field.

23 Claims, 3 Drawing Sheets

HIGH-FIELD MAGNETS USING HIGH-CRITICAL-TEMPERATURE SUPERCONDUCTING THIN FILMS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to superconducting magnets, particularly to magnets fabricated from high $T_c$ superconducting materials, and more particularly to high-field magnets fabricated from high $T_c$ superconducting ceramic thin films.

Since the discovery of superconducting material development efforts have been underway to utilize this material for various applications including coils, solenoids, magnets, etc. The early metal type superconductor, such as a Ti-Nb alloy and $Nb_3Ge$ had a critical temperature ($T_c$) which could not exceed 23.2 K and hence the use of liquidized helium (boiling point of 4.2 K) as the cryogen for superconductivity, and thus limited the application of superconducting materials.

The discovery of a new type of superconducting material, generally referred to as an oxide type superconductor, having a much higher $T_c$ was revealed by Bednorz and Miller in 1986, and had a $T_c$ of 30 K. Also, in 1987 the discovery of another type of superconducting material was reported by C. W. Chu et al. having a critical temperature of about 90 K and referred to as YBCO, being a compound oxide of the Ba-Y system represented by $YBa_2Cu_3O_{7-x}$.

Since the discovery of high $T_c$ oxide superconductor in 1986, research has furiously been underway worldwide to understand and optimize critical parameters of these materials in order to build useful devices based on their extraordinary characteristics. Various classes of these materials can be routinely fabricated by a number of techniques with $T_c$ well above liquid nitrogen ($LN_2$) temperature (77.3 K at 1 atm pressure) and upper critical fields ($B_{c2}$) that are extremely high (measured to be in excess of 100 Tesla (T) for YBCO at 6 K). However, only recently have large area (>1 $cm^2$) high $T_c$ thin films been grown that have critical current densities ($J_c$) which surpass the best low $T_c$ superconductors in the presence of magnetic fields. The extentiveness and volume of these prior efforts are exemplified by the following U.S. patents issued during the July–October 1990 time period: U.S. Pat. No. 4,942,142 issue Jul. 17, 1990 to H. Itozaki et al.; U.S. Pat. No. 4,948,779 issued Aug. 14, 1990 to W. C. Keur et al.; U.S. Pat. No. 4,959,346 issued Sep. 25, 1990 to A. Mogro-Campero et al.; U.S. Pat. No. 4,959,348 issued Sep. 25, 1990 to K. Higashibata et al.; U.S. Pat. No. 4,962,086 issued Oct. 9, 1990 to W. J. Gallagher et al.; and U.S. Pat. No. 4,965,247 issued Oct. 23, 1990 to M. Nichiguchi.

The best results are on substrates with: 1) good lattice match to the film, 2) which do not react with the film at the high temperatures required by deposition (about 750° C.), and 3) which have a reasonably well matched thermal coefficient of expansion. The above-referenced U.S. Pat. Nos. 4,948,779 and 4,959,346 have attempted to satisfy these requirements by the addition of a buffer layer between the substrate and the YBCO. These three requirements are well met by substrates fabricated from strontium titanate ($SrTiO_3$) and lanthanum illuminate ($LaAlO_3$). Yttria-stabilized zirconia (YSZ) is useful as a substrate at all but the highest deposition temperatures, where it starts to react with the YBCO. Large area films of YBCO expitaxially grown on $LaAlO_3$ were measured to have $J_c$ (4 K, 1 T)$=1\times10^7$ A/$cm^2$ and $J_c$ (77 K, 0 T)$=5\times10^6$ A/$cm^2$. More recent data show $J_c$ about a factor of 2 better than those cited above for $LaAlO_3$ and $SrTiO_3$ at the similar conditions, wherein $J_c$ (77 K, 2 T) has been measured to be $\sim5\times10^6$ A/$cm^2$.

An additional requirement for very large area films (>10 $cm^2$) is an inexpensive substrate with high thermal conductivity for rapid removal of heat (if necessary) during operation of superconductive devices. High thermal conductivity during deposition is beneficial, but not necessary. Such a condition would be met by a substrate of sapphire, but high $T_c$ films tend to react with this substrate at high temperatures. It has recently been reported that high $J_c$ films on sapphire ($\sim$2–3 times lower than the best results reported previous) using a buffer layer of $SrTiO_3$. This $J_c$ data is 2–3 orders of magnitude better than the best available data in YBCO wires and tapes. This is the main reason why there are not many new high-field $T_c$ superconducting magnets. In addition, these oxides are very brittle making them extremely difficult to wind.

Further, properly fabricated superconducting material will remain superconducting only if operated: 1) below a certain critical temperature $T_c$,2 ) below the $J_c$, and 3) below a critical magnetic field (or magnetic induction) $B_c$. These three parameters are interdependent and must be known to optimize the design of a useful magnet.

It is thus seen that while researchers have attempted to use high-critical-temperature, superconducting ceramic (HTSC) materials to fabricate useful superconducting magnets that can operate at temperatures well in excess of liquid helium (He) temperature, most of the work has been focused on fabricating wires and tapes from bulk HTSC materials with sufficiently high critical current density ($J_c$), and although progress has been made, the $J_c$ for wires and tapes remains about two orders of magnitude less than that for large-area HTSC thin films. Thus, there is a need for a magnet fabricated from high-critical-temperature superconducting ceramic thin film. The present invention satisfies that need by providing a high-field magnet using HTSC films formed by stackable disk-shaped substrates coated with HTSC thin films and which can generate fields greater than 10 T.

SUMMARY OF THE INVENTION

It is an object of the present invention to provide a high-field magnet fabricated from high $T_c$ superconducting ceramic thin films.

A further object of the invention is to provide high-critical-temperature superconducting ceramic (HTSC) thin film magnets capable of generating fields greater than 4 Tesla.

A further object of the invention is to provide a high-field magnet fabricated from stackable disk-shaped substrates coated with high-critical-temperature superconducting ceramic thin films.

Another object of the invention is to provide a high-field magnet formed from at least one substrate with thin films of superconducting material on both sides of the substrate.

Another object of the invention is to provide a high-field magnet formed from substrates having ≧5 cm diameters and including substrates having at least a plurality of HTCS layers on one side.

Another object of the invention is to provide a high-field magnet using HTSC spiral thin film coated on a substrate and having variable line widths of the spirals.

Another object of the invention is to provide a stacked-disk HTSC thin film magnet capable of generating high magnetic fields by maximizing $J_c$, superconducting film thickness, number of superconducting layers per substrate, substrate diameter, and number of substrates while minimizing substrate thickness.

Another object of the invention is to provide a stacked-disk HTSC thin film magnet using variable substrate thicknesses and having the thinner substrates near the center of the stack.

Other objects and advantages of the invention will become apparent from the following description and accompanying drawings. Basically, the invention involves a magnet made up of a stack of disk-shaped substrates, up to 1000 disks having diameters of up to 12 inches and thickness of less than 80 mils, coated with HTSC thin films, having a thickness up to 5 μm. At least some of the thin films formed on the substrates are in a spiral configuration with a variable line width, such that the wider line widths are in the center and the thinner are towards the outer edges. The thin film may be composed of YBCO, for example, with a thickness of about 0.5–1 μm and may include a buffer and/or insulator layers so as to have an overall thickness of ~5 μm. The substrates may include a plurality of HTSC layers on each side thereof with buffer layers there between and the thickness of the substrates may vary with the thinner near the center of the stack. Also, the individual substrates may include an insulation layer covering the outermost thin film, and may be grooved to keep the thin film from moving on the substrate. In addition, the stacked disk-shaped substrates may be provided with feed-throughs for interconnecting the thin films coated thereon.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

The invention is directed to high-field magnets using stackable disk-shaped substrates having formed thereon thin films of high-critical-temperature ($T_c$) superconducting ceramic material. The stackable disk-shaped substrates may be coated with the high-critical-temperature superconducting ceramic (HTSC) materials on one or both sides thereof, and there may be a single or a plurality of pattern layers coated on one or both sides of the substrate (see FIG. 2). Depending on the composition of the substrate, a buffer layer may be required between the substrate and the pattern of HTSC material (see FIG. 2). Also, in some applications it may be advantageous to form grooves in the substrate and deposit the buffer and/or HTSC material into the grooves to prevent movement of the HTSC material with respect to the substrate. The HTSC material is preferably deposited in a tapering spiral configuration on the disk-shaped substrates (see FIG. 4) with the greatest width near the center of the substrate, and with the loops of the spiral being a constant distance apart.

Figure 1:
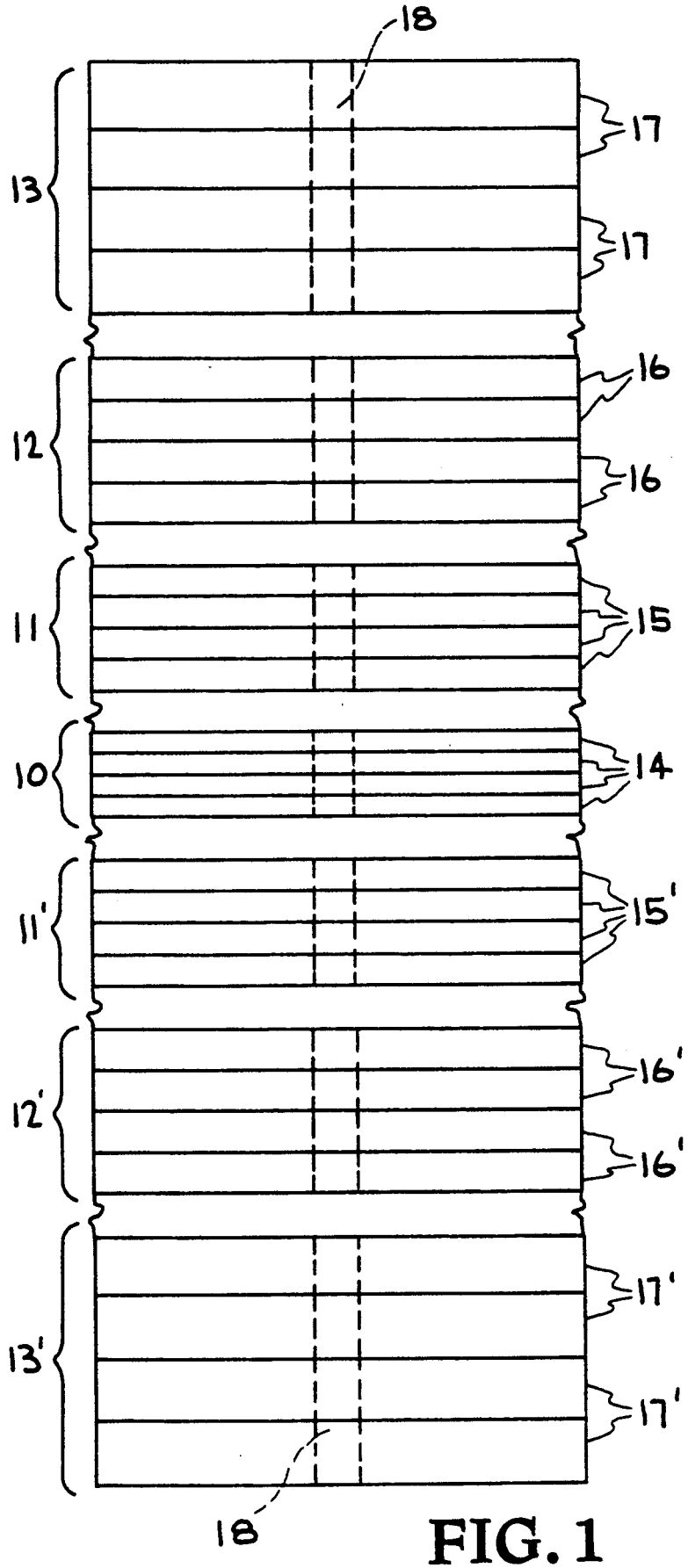
FIG. 1 is a partial external view of a high-field superconductivity magnet, without electrical and cooling apparatus, utilizing stacked disk-shaped substrates coated in accordance with the present invention.

The magnet may be formed from up to 1000 disks, for example, with the disks varying in thickness such that the thinner disks are located in the central area of the magnet, and/or wherein the disks may be formed as continuous reductions from the outer to the central areas, or from adjacent zones with each zone containing a plurality of the same thickness disks, but the zones decreasing in thickness from the outer-most to the center of the stack (see FIG. 1). The area of highest field should be in the axial central section of the stack of disks. Under certain applications a layer of selected metal and/or layer of insulative material may be deposited on the outer surface of an HTSC coating. Each of the disks includes a central bore and the diameter of the bore is proportional to the diameter of the disk depending on the application and the strength of the field desired. Interconnects between pattern layers of the HTSC material of a disk and between the disks (see FIG. 3) are ideally composed of superconducting material, but may if necessary be composed of high conductivity metal.

The magnet is retained at a desired operating temperature and may, for example, be cooled by liquid nitrogen ($LN_2$), temperature of 63–84 K, such that the desired critical current densities ($J_c$) are obtained. The cooled high $T_c$ thin film stacked disk magnet of this invention is capable of generating fields greater than 2 Tesla (T). The temperature of $LN_2$ is a function of pressure—by pumping the $LN_2$ the temperature can be lowered to ~63 K; at 2 atm pressure $LN_2$ will be ~84 K.

As set forth above, for best results in depositing superconductive thin film material, such as $YBa_2Cu_3O_{7-x}$ (YBCO), on a substrate, there should be good lattice match between the substrate and the film, the substrate does not react with the film at the temperatures required for deposition, and the substrate and film should have a reasonably well matched thermal coefficient of expansion. Where these three requirements are not met, it becomes necessary to deposit a thin buffer layer of suitable material on the substrate prior to depositing the superconducting thin film. While the above three requirements for substrates are met for example by strontium titanate ($SrTiO_3$) and lanthanum illuminate ($LaAlO_3$), and at certain deposition temperatures by yttria-stabilized zirconia (YSZ), it has been determined that other substrate materials, such as sapphire, with a buffer or barrier layer, such as $SrTiO_3$, deposited thereon, with the YBCO thin film deposited on the buffer layer, produces higher $J_c$ films than the sapphire substrates having thin films of YBCO deposited directly thereon.

As also set forth above, for very large area films ($\geqq 10$ $cm^2$) the substrate should have a high thermal conductivity at the temperatures of operation, and such requirement is met by sapphire, which is currently available in disks of up to 12 inch diameter. Thus, using stackable disk-like substrates in accordance with the present invention eliminates the winding problem of these very brittle materials, since the high $T_c$ films can be deposited on the disks in desired patterns and appropriate shapes without having to flex these fragile compounds.

Basically, the present invention involves a compact, low weight, high field magnet that is scaleable and can be operable with an $LN_2$ cooler or a Stirling cooler. The magnet of this invention will be useful for any high field, small bore solenoid applications, especially where weight and cooling costs are major considerations. The unique structure of the magnet of this invention enables one to change properties of the field on each layer deposited on the disk-like substrates. Therefore, it has Wiggler applications which require the field to alternate on a 100–500 μm scale, or a transformer (by adjusting the turns ratio) of adjacent disks.

As will become more apparent hereinafter, the stackable disks may be fabricated with various diameters, thicknesses, and bore sizes, and the high $T_c$ films may be deposited in various configurations on one or both sides of the substrate, and may include a number of layers of $T_c$ film on each side of the substrate, with the layers being separated by a buffer layer. Thus, the stackable disks can be designed to produce magnets of various shapes, sizes, and field strengths by varying the configuration and/or layers of the high $T_c$ film deposited thereon, and by utilizing various numbers of disks and varying the thicknesses of the disks. For example, five (5) to one thousand (1000) stackable disks may be used, provided however, the thinner (higher field) disks are located in the central section of the magnet as illustrated by the FIG. 1 embodiment.

By way of example and for simplicity of explanation of the stackable disk approach of this invention, with a magnet of five (5) disks varying in thicknesses from 10 to 40 mils, for example, the center disk (say 10 mils thick) would utilize the thinner substrate of the five disks and be coated on both sides with one or more thin films, the two adjacent disks would be thicker (say 20 mils) and each coated with identical thin film layer or layers on both sides of the substrate, and the two outer disks would be thicker than the adjacent disks (say 40 mils) and each coated on only the inner side with the same thin film layer or layers. Each of the layers of thin film material of the various disks would be interconnected by high $T_c$ material. The thin film would be deposited in a spiral configuration with the inner end of the spiral being of greater width than the outer end and with the loops of the spiral being a constant distance apart. Thickness of the disks, including the number of layers of thin film, and the configuration thereof, deposited on a substrate, is determined by the desired shape of the field and the maximum field strength needed for a specific application or use.

Figure 2:
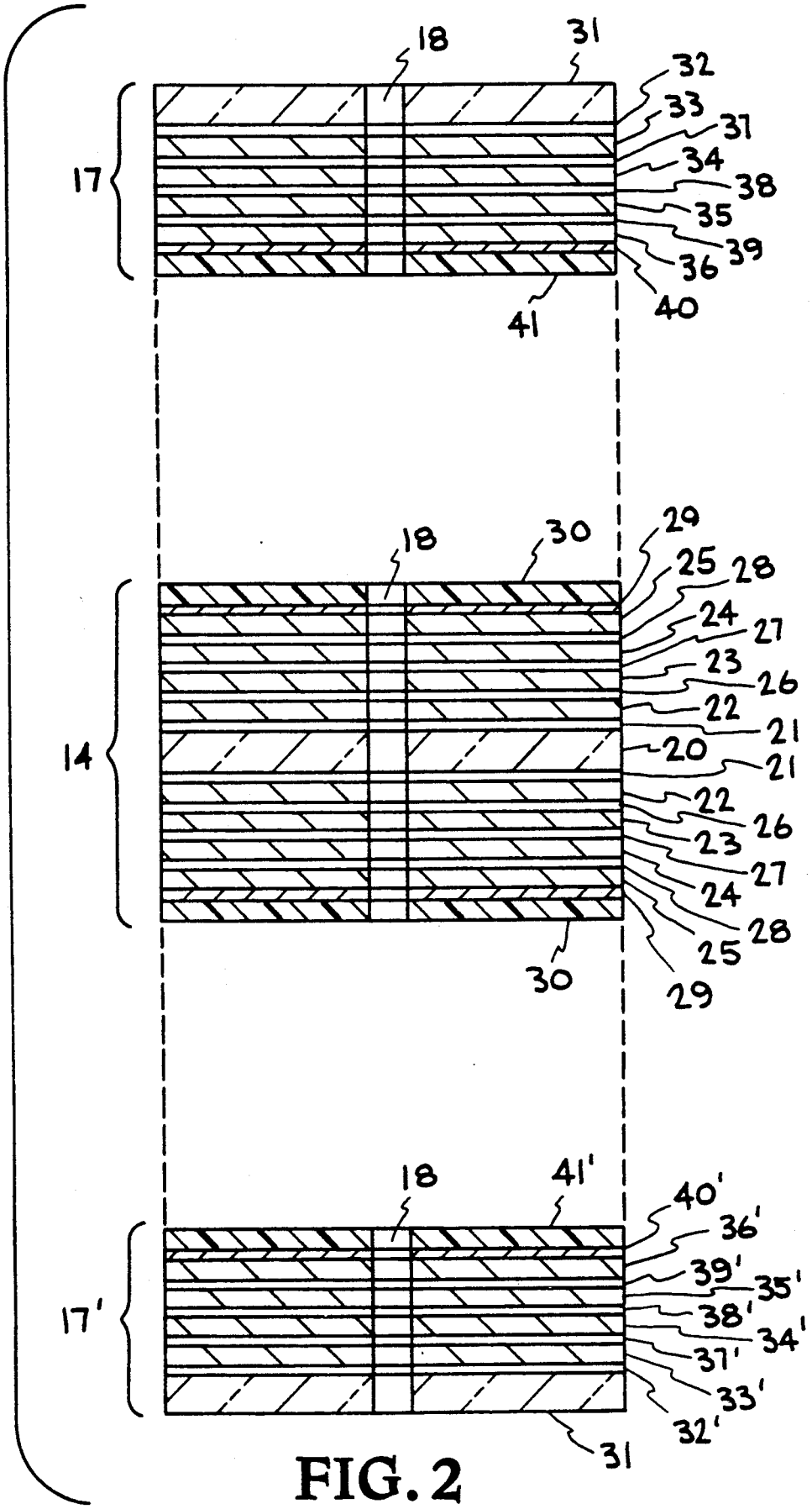
FIG. 2 is an enlarged cross-sectional view of certain of the stacked disk-shaped substrates of the FIG. 1 magnet.

In larger application utilizing up to 1000 disks, for example, the disks would vary in thickness from a central point or zone to two outer points or zones, and may include a plurality of intermediate zones with each adjacent outer zone including one or a plurality of disks of a thickness greater than the adjacent inner zone, such that each zone increases outwardly in disk thickness from both sides of the central zone. The zone type stacking arrangement is illustrated in FIG. 1. Generally, each corresponding pair of zones as they extend outwardly from the center of the magnet are of substantially identical thickness and identical thin film configuration and number of layers, such as illustrated in FIG. 2. However, for certain application the disk thickness and/or thin film configuration/layers of the corresponding zone pairs may be varied. By merely changing the disk thickness and diameter and/or thin film configuration/layers the stacked disk magnet approach provides for a variety of different applications as determined by the desired field strengths required.

As set forth above, properly fabricated superconducting material will remain superconducting only if operated below a certain critical temperature $T_c$, below the $J_c$, and below a critical magnetic field, or magnetic induction, $B_c$. These three parameters are interdependent and must be known to optimize the design of a useful magnet. During the experimental verification of the present invention HTSC thin film coils were fabricated so that such could be tested at various magnetic fields or inductions, B, to determine the dependence of $J_c(B)$ at different temperatures. Once an operating temperature is chosen and the $J_c(B)$ is determined at that temperature, an optimal solenoid design could be determined.

It has been established by experimental verification that high magnetic fields will result for a stacked-disk solenoid by: 1) maximizing $J_c$, 2) maximizing superconducting film thickness, 3) maximizing the number of superconducting layers, 4) maximizing the substrate diameter, 5) maximizing the number of substrates, and 6) minimizing the substrate thickness. HTSC films have been routinely fabricated with $J_c(OT,77\ K) > 10^6 A/cm^2$ and $J_c(OT,4.2\ K) > 10^7 A/CM^2$ for film thickness up to 1 μm on substrates that are $<5$ cm in diameter. Substrates with at least four such HTSC layers on a side are being developed with 7.5- and 10-cm-diameter substrates. Forltyn et al., Appl. Phy. Lett. 59, 1374, 1991 have reported development of double-sided deposition techniques for $YBa_2Cu_3O_{7-x}$ films deposited by pulsed laser deposition, with $J_c(OT,77\ K) = 2.5 \times 10^6 A/cm^2$. Fragile $LaAlO_3$ substrates, which are 0.025 cm thick ($\sim$half the standard substrate thickness), are routinely used for HTSC deposition and patterning. Techniques that allow for double-sided processing are favored on correspondingly thicker substrates because any stresses induced between the films and substrate tend to counterbalance. The number of substrates in a stack is limited primarily by cost.

With current technology the following parameters are achievable: 1) double-sided wafers 7.5 cm in diameter and 0.025 cm thick, 2) bore diameter=0.25 cm, 3) four layers of 1-μm HTSC films on each side, 4) a stack of up to 200 wafers, and $J_c \sim 10^6 A/cm^2$. Such parameters result in a central field of $>10$ T. However, the B generated by a stack of $>200$ disks will be highest near the innermost turn (bore) of the central disk and will decrease radially outward within each disk and axially outward from the central disk. Because $J_c$ and $T_c$ decrease with increasing B, a more effective magnet can be fabricated by using correspondingly higher density of superconducting material placed where B is expected to be higher to keep J near, but below, $J_c$.

During experimental verification of this invention, $J_c(B)$ was modeled using the equation or formula:

$$J_c(B)=J_c(0)/(1+B/B_0)^n,$$

where $B_0$ and n are fitting parameters. It was shown that a field improvement of about two to four (with maximum improvement for small n) can be expected by varying the line width of the superconductor within a given disk (line width thicker near center of spiral). Similarly, it has been verified that a given maximum induction, $B_{max}$, can be generated from fewer disks by using thicker disks near the axial edges of the stack. Continuously varying the current density within the solenoid to match the expected B value is straightforward using photolithography, but is extremely difficult using conventional magnet-winding methods.

Figure 4:
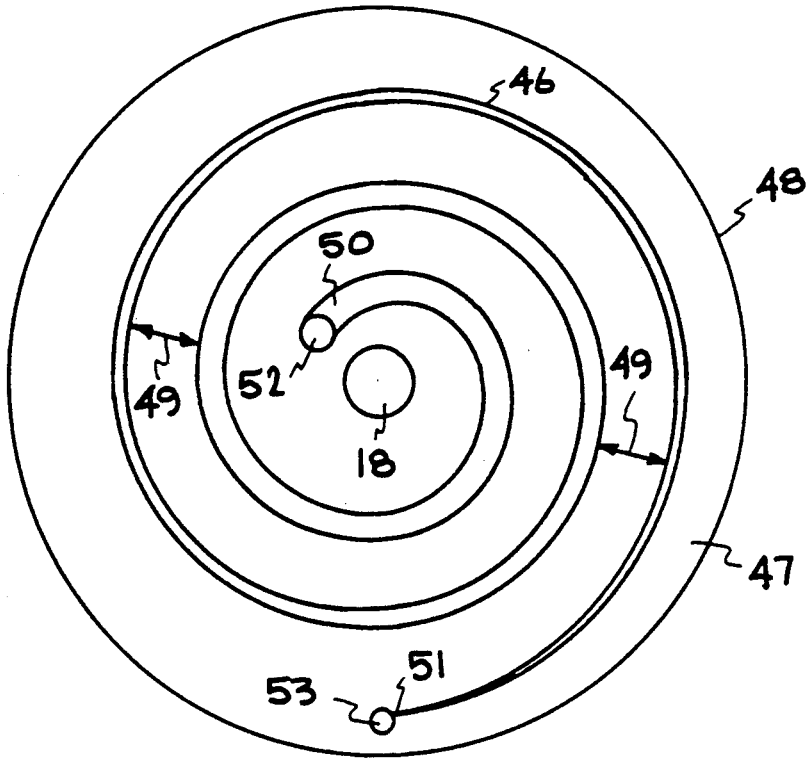
FIG. 4 is a plan view of an enlarged simplified disk-shaped substrate with a single pattern of superconductive material formed thereon and illustrating certain of the interconnects of FIG. 3.

During the development and verification of the present invention substrates were patterned with variable line widths of $YBa_2Cu_3O_{7-x}$(YBCO) film, such a substrate being illustrated in FIG. 4. The YBCO film deposition was done by off-axis sputtering, for example, and contacts and shunting were prepared by gold or silver deposition before patterning was done by photolithography coupled with low-voltage (~450 V) ion milling. Post patterning oxygenation was done in flowing oxygen at 475° C. for ~8 hours. To connect the sample to copper or aluminum pads on the substrate holder, 0.01-cm-diameter aluminum wire bonds were used, to connect to current leads so as to allow a maximum current of 10 A through the coil.

The invention verification involved probing measurements made for external magnetic induction applied normal to the substrate or to the current-carrying plane in the YBCO film. The $J_c$ was measured by transport using a 1-μV/cm criterion through 40-cm lengths of 800-μm constant line width by 1-μm-thick YBCO coils. Curves were fitted using the above formula or formula, and the curve for $J_c$(B,4.2 K) fitted well for n=0.51. This value allows for a field improvement of up to a factor of ~4 by using variable line width patterning, such as illustrated in FIG. 4. The curve for $J_c$(B,20 K) fit well for n=1.0. The initial results at 66 K and 77 K were not satisfactory due to flux pinning problems at higher fields and such have been overcome by various techniques, such as neutron irradiation, as described in the literature.

It has been demonstrated during invention verification that the shear forces generated by the J×B hoop stresses are adequately resisted by the adhesion of the YBCO film to the substrate. The samples tested at 4.2 K and 20 T survived hoop stresses in excess of $7.7\times10^6$Pa. Also, it has been demonstrated that patterning techniques to create the spiral windings on the disk-like substrates are readily available, these being, for example, standard wet lithography and laser direct-write patterning. In addition, the technology is available for forming the bores in the thin fragile disk-like substrates, this being done for example by ultrasonic drilling, abrasive spraying, or growing the crystal substrate around a removable post.

Referring now to the drawings, FIG. 1 illustrates a zone type stacked-disk magnet, without the associated electrical interconnects and cooling system. The magnet of the FIG. 1 embodiment illustrates zones 10, 11'-11', 12-12' and 13-13', with zone 10 being the central zone and zones 13-13' being the two outer or end zones. Only three (3) zones are illustrated on each side of central zone 10 for simplicity. Each of the zones includes a plurality of thin-film coated disk-like substrate assemblies generally indicated at 14, 15-15', 16-16' and 17-17', each substrate having a bore 18 and a plurality of thin films of superconducting material deposited thereon, as illustrated in FIG. 2. Note that each of the indicated zones are adjacent one or more zones not illustrated as indicated by the broken lines between zones, with the total number of the zones and the thickness of the substrates of a desired magnet depending on the desired shape of the field and/or the maximum field strength. The thickness of the individual substrates of each of zones increases in each adjacent outer zone such that the substrate assemblies 14 of central zone 10 are substantially thinner than the substrate assemblies 17-17' of outer zones 13—13. For example, the substrate assemblies 14 of the central zone 10 may have a thickness of 2 mils and the substrate assemblies 17-17' of the outer zones 13-13' may have a thickness of 40 mils, with each of the substrate assemblies having a diameter of about 1–12 inches, with the bore 18 having a diameter of about 0.1–6.0 inches. As will be seen more clearly from FIG. 2, each of the substrate assemblies of the zones 10-13' have thin films deposited on each side thereof except the outermost substrate assemblies of zones 13-13' on which the thin films are deposited only on the inner sides of these substrate assemblies. Also, generally the corresponding substrate assemblies or zones of substrate assemblies on each side of the central substrate assembly or zone are identically constructed, but each of those corresponding substrate assemblies or zones may be constructed differently from the adjacent substrate assembly or zone. For example, with five (5) substrate assemblies having thin films deposited thereon and the central being identified as No. 5, the adjacent substrate assemblies being identified as Nos. 3 and 4, and the outer substrate assemblies identified as Nos. 1 and 2, substrate assemblies 3 and 4 would be identical and substrate assemblies 1 and 2 would be identical, but substrate assemblies 3 and 4 may differ in construction from substrate assemblies 1 and 2.

As seen in FIG. 2, one of the substrate assembly 14 of central zone 10 and the outermost substrate assemblies 17 and 17' of the two outer zones 13 and 13' are illustrated in detail. It is to be understood that the illustration of the details of these substrate assemblies are not to any scale, but merely shows the adjacent layers comprising the substrate assemblies illustrated in the FIG. 1 magnet.

Central substrate assembly 14 comprises a central disk-like member or substrate 20 composed of sapphire having a diameter of four inches, a thickness of 10 mils, with a bore 18 diameter of 0.12 inch, on both sides of which are deposited buffer layers 21 of $CeO_2$ having a thickness of 200 Å. Deposited on each of the buffer layers 21 are four (4) layers 22, 23, 24 and 25 of YBCO, each having a thickness of 1 μm, and alternating buffer layers 26, 27 and 28 of $CeO_2$, each with a thickness of ~200 Å. Deposited on each of the outer YBCO layers 25 is a layer 29 of metal, such as gold or silver having a thickness of 2–20 μm, and on each of which is a layer 30 of insulation material, such as low temperature plastic (Mylar, Kevlar, Teflon) having a thickness of 10–100 μm. The metal layers 29 function as shunt path for the superconducting material should it go normal, but can be omitted if desired.

Outer substrate assemblies 17 and 17' are constructed identically, and thus will be given similar reference numerals. These substrate assemblies comprise disk-like members or substrates 31 and 31' composed of sapphire having a diameter of four inches, a bore diameter of 0.12 inch, and a thickness of 40 mils, on one side of each is deposited buffer layers 32 and 32' of $CeO_2$ having a thickness of 200 Å. Deposited on the buffer layer 32 and 32' are four (4) layers 33-33', 34-34', 35-35', and 36-36' of YBCO having a thickness of 1 μm, with alternating buffer layers 37-37', 38-38', and 39-39' of $CeO_2$, each with a thickness of 200 Å. Deposited on the outer YBCO layers 36-36' is a layer 40-40' of metal, such as gold or silver, having a thickness of 2–20 μm, and on each of which is deposited a layer 41-41' of low temperature plastic (Mylar, Kevlar, Teflon) or other suitable insulator materials. As with the substrate assembly 14, the metal layers 40-40' may be omitted for certain applications.

While the substrate assemblies 14, 17 and 17' have been described above using a disk-like member or substrate constructed of sapphire each could be composed of lanthanum aluminate ($LaAlO_3$), strontium titanate ($SrTiO_3$), or yttria-stabilized zirconia (YSZ). In addition, the substrates could be composed of cerium oxide, neodymium gallate, and magnesium oxide. If $LaAlO_3$ or $SrTiO_3$ was used the adjacent buffer layer could be omitted and the YBCO could be deposited directly thereon.

By way of example, if the above description of substrate assemblies 14, 17 and 17', as illustrated in FIG. 2 were modified to use $LaAlO_3$ as the disk-like members or substrates 20, 31 and 31' instead of sapphire, the buffer layers 21, 32 and 32' would be omitted. If $LaAlO_3$ was used the substrates of the magnet would be smaller in diameter, i.e. 1–4 inches, with the same thickness, i.e. 2–40 mils, and with a bore diameter of 0.1–2 inches, since $LaAlO_3$ is not yet available in large diameter substrates. A preferred substrate or disk-like member made of $LaAlO_3$ would have a 3 inch diameter, 10 mil thickness, and 0.12 inch bore diameter, and but for the diameter of the YCBO and intermediate buffer layers of $CeO_2$, the metal layers, and the insulation layers described above with respect to FIG. 2 would be the same if $LaAlO_3$ was used as the disk-like member.

While the buffer layers are exemplified above as being composed of $CeO_2$, they may be composed of $LaAlO_3$, $SrTiO_3$, MgO, and yttria stabilized $ZrO_2$, for example. Also, the disk-like members or substrates may be grooved in the areas of the YBCO thin-film patterns thereon should there be insufficient bonding between the material of the substrate and the thin-film material.

Figure 3:
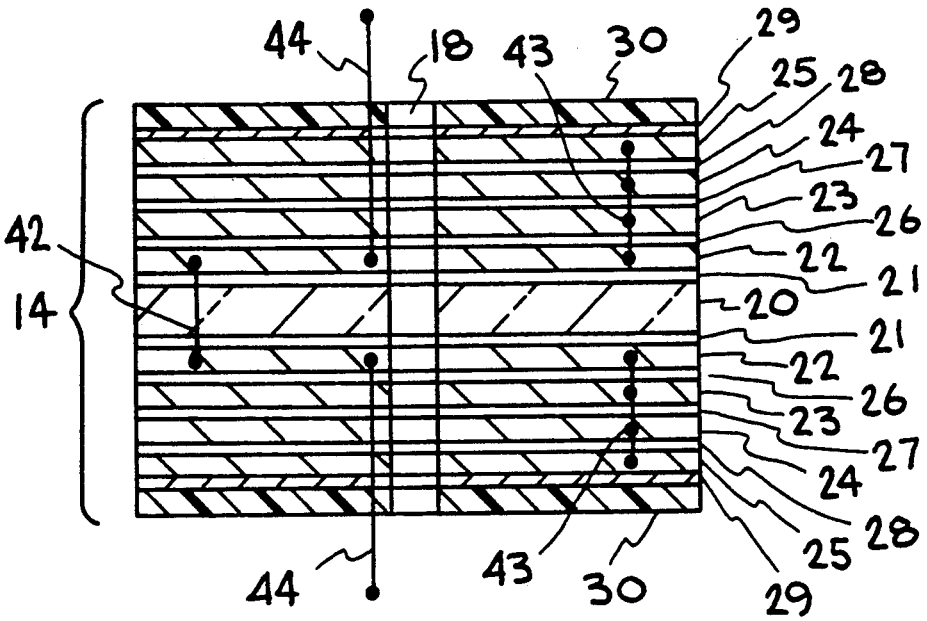
FIG. 3 is a view of the center disk of FIG. 2 showing the superconductive interconnects between layers of a disk and between the disks.

The adjacent thin-film layers of each substrate assembly and the adjacent substrate assemblies are electrically connected by interconnects as illustrated in FIG. 3. As shown in FIG. 3, which is an enlarged view of the substrate assembly 14 of FIG. 2, YBCO layers 22 are interconnected by an interconnect 42 which passes through buffer layer 21 and substrate 20. YBCO layers 22, 23, 24 and 25, on each side of substrate 20 are interconnected by interconnects 43. Interconnects 44 are secured at one end to each of the inner YBCO thin films 22 and extend through or along bore 18 for interconnection with an adjacent substrate or an adjacent substrate assembly. Each of the interconnects 42–44 are preferably composed of YBCO material, and are constructed by forming holes through the various layers involved and filling same with the interconnect material.

FIG. 4 illustrates a spiral-configured thin film of superconducting material, such as YBCO, deposited on a surface of a substrate or on a buffer layer as described above with respect to FIG. 2. FIG. 4 is an enlarged, simplified showing of a YBCO thin film spiral, which in reality would contain numerous loops of the spiral (30–300 for example depending on the loop thickness and the disk diameter). Only one layer of thin film and only one side of the substrate are illustrated in FIG. 4 for simplicity of illustration. Where the thin film spiral is deposited on both sides of the substrate the spiral of the top side would be in a clockwise direction and on the bottom side in a counter-clockwise direction or vice-versa.

As seen in FIG. 4 a thin film 46 of YBCO is deposited on a surface 47 of a substrate 48 in a spiral configuration. The loops of the thin film spiral are at a constant distance from each other as indicated 49. The thin film 46 extends from an inner end 50 located adjacent to bore 18 to an opposite or outer end 51 located adjacent to an outer edge of substrate 48. The line width of the thin film 46 varies or tapers from inner end 50 to outer end 51, with the line width at the inner end 50 being wider, as seen in FIG. 4. The line width is variable with a factor of 4–500. The minimum line width is about 5μ and the maximum line width is about 5 mm, and a nominal line width varies or tapers from about 10 μm at the small or outer end 51 to about 1 mm at the larger or inner end 50 (a factor of 100). The desired field strength, disk diameter, and line width will determine the number of loops and maximum line width in the spiral. The space or spacing 49 between the loops of film 46 is constant and approximately calculated by the formula: minimum line width/4, with an example being 2.5 μm (10 μm/4). The space or spacing 49 between the loops of film 46 is exaggerated in FIG. 4 relative to the thickness or line width of the loops of thin film 46 for illustration purposes only, while in actual fabrication the space 49 would only be ¼ the width of the film 46. The substrate 48 is provided with a pair of holes 52 and 53 extending there through and which are filled preferably with YBCO and in contact with ends 50 and 51 of film 46 so as to function as the interconnects between the YBCO layers and/or the substrate assemblies, as described above with respect to FIG. 3. As pointed out above, the films are deposited on opposite sides of the substrate in opposite spiral directions to maintain the same current sense throughout the stack.

It has thus been shown that the present invention provides a superconducting magnet that can operate at liquid nitrogen ($LN_2$) temperatures (63–84 K) and can generate fields greater than 4 T. The superconducting magnet of this invention is formed by stacking disk-like or disk-shaped substrates having a high-critical-temperature, superconducting ceramic (HTSC) material, such as YBCO, deposited on at least one side of each substrate in a spiral configuration. The disk-like substrates are formed in various thicknesses and stacked such that the thinnest of the substrates are at the axial center of the magnet.

While particular embodiments, materials, parameters, etc. have been illustrated and/or described to set forth the principle features of the invention, such are not intended to limit the invention to the specifics illustrated or described. Modifications and changes will become apparent to those skilled in the art. It is intended that the scope of the invention includes all such illustrated and/or described embodiments, materials, etc. as well as modifications and changes which fall within the scope of the appended claims.

We claim:

1. A high-field magnet comprising:

a plurality of disk-like substrates, said disk-like substrates being of variable thickness;

each of said substrates having at least one pattern of high-critical-temperature superconducting material having a thickness of 0.5-1 μm deposited on at least one side thereof;

said disk-like substrates being stacked such that thinner substrates are located in an axially central location and thicker substrates are located in an axially outer location, such that the thickness of the substrates increases in thickness from the central location to the outer location.

2. The magnet of claim 1, wherein each of said patterns deposited on said substrates has a spiral configuration.

3. The magnet of claim 2, wherein at least certain of said spiral patterns have a varying width along the length thereof.

4. The magnet of claim 3, wherein said certain of said spiral patterns are wider at an inner end and gradually decrease in width toward an outer end thereof.

5. The magnet of claim 3, wherein said certain of said spiral patterns have a line width of about 5 μm to about 5 mm.

6. The magnet of claim 2, wherein said spiral patterns are constructed such that loops of the spiral are at a constant distance from each other.

7. The magnet of claim 6, wherein said constant distance between loops of said spiral pattern is defined by the minimum line width divided by approximately four.

8. The magnet of claim 1, wherein said disk-like substrates have a thickness of about 2-80 mils.

9. The magnet of claim 1, wherein said disk-like substrates have a diameter in the range of 1 to 12 inches, and each is provided with a bore having a cross-section of 0.1 to 6.0 inches.

10. The magnet of claim 1, additionally including a layer of buffer material between a surface of the substrate and the deposited pattern of material.

11. The magnet of claim 1, wherein said disk-like substrates are constructed of material selected from the group consisting of sapphire, strontium titanate, lanthanum aluminate, yttria-stabilized zirconia, cerium oxide, neodymium gallate, and magnesium oxide.

12. The magnet of claim 11, additionally including a layer of buffer material between the substrate and the deposited pattern of material, said buffer layer material being selected from the group consisting of $CeO_2$, $LaAlO_3$, $SrTiO_3$, MgO and yttria-stabilized $Z_rO2$.

13. The magnet of claim 12, wherein said disk-like substrate is composed of sapphire having a diameter in the range of 1-12 inches, a thickness in the range of 2-80 mils, and said substrate includes a bore extending there through and having a diameter in the range of 0.1-6.0 inches.

14. The magnet of claim 13, wherein said buffer layer is composed of $CeO_2$ having a thickness in the range of 50-1000 Angstroms.

15. The magnet of claim 14, wherein said substrate has at least four layers of said deposited pattern material on at least one side thereof, and additionally including a layer of buffer material intermediate said layers of deposited pattern material, said layers of said deposited pattern material each having a thickness of about 1 μm.

16. The magnet of claim 15, wherein each of the layers of deposited pattern material is deposited in a spiral configuration and such that an inner end of the spiral has a greater width than an outer end of the spiral.

17. The magnet of claim 16, wherein said spiral configuration is formed such that there is a constant distance between adjacent loops thereof.

18. The magnet of claim 17, wherein said deposited pattern material forming said spiral has a line width in the range of about 5μ to about 5 mm, and wherein the constant spacing between loops of said spiral is determined approximately by the minimum line width divided by 4.

19. The magnet of claim 18, wherein said plurality of disk-like substrates comprise at least five disk-like substrates.

20. The magnet of claim 19, additionally including superconducting or highly conductive means for interconnecting said plurality of disk-like substrates and at least interconnecting certain of said deposited patterns of material.

21. A superconducting magnet including at least five disk-like axially stacked substrates, having bores extending there through, wherein:

said substrates being positioned in groups of different thicknesses such that thinner substrates are located in a central axial region;

each of said substrates, except an outer two substrates, being provided with at least one layer of $YBa_2Cu_3O_{7-x}$ (YBCO) having a thickness of up to 1 μm on opposite sides thereof;

said layer of YBCO defining a spiral configuration having a plurality of loops;

at least a layer of insulating material on an outer layer of YBCO; and superconducting means for at least interconnecting certain of said layers of YBCO of said substrates.

22. The superconducting magnet defined in claim 21 wherein, said substrates have a thickness in the range of about 2-40 mils, a diameter of 1-12 inches, and a bore diameter of 0.1-6 inches.

23. The superconducting magnet defined in claim 22, wherein a layer of buffer material is located intermediate said substrate and said layer of YBCO, said layer of buffer material having a thickness in the range of 50-1000 Å.

* * * * *